US010323796B2

(12) United States Patent
Frenal et al.

(10) Patent No.: US 10,323,796 B2
(45) Date of Patent: Jun. 18, 2019

(54) ASSEMBLY OF A SUPPORT AND GAS CONTAINER SUCH AS A MEDICAL GAS CYLINDER

(71) Applicant: L'Air Liquide, Societe Anonyme Pour l'Etude et l'Exploitation des Procedes Georges Claude, Paris (FR)

(72) Inventors: Antoine Frenal, Ezanville (FR); Renaud Ligonesche, Herblay, TX (US); Chiara Tarantello, Puteaux (FR)

(73) Assignee: L'Air Liquide, Société Anonyme pour l'Etude et l'Exploitation des Procédeés Georges Claude, Paris (FR)

( * ) Notice: Subject to any disclaimer, the term of this patent is extended or adjusted under 35 U.S.C. 154(b) by 703 days.

(21) Appl. No.: 14/556,262

(22) Filed: Dec. 1, 2014

(65) Prior Publication Data

US 2015/0167897 A1 Jun. 18, 2015

(30) Foreign Application Priority Data

Dec. 13, 2013 (FR) ..... 13 62596

(51) Int. Cl.
*F17C 13/06* (2006.01)
*F17C 13/08* (2006.01)

(52) U.S. Cl.
CPC ..... *F17C 13/084* (2013.01); *F17C 13/06* (2013.01); *F17C 2201/0109* (2013.01);
(Continued)

(58) Field of Classification Search
CPC ..... F17C 13/084; F17C 2205/01; F17C 2205/0153; F17C 2205/0188;
(Continued)

(56) References Cited

U.S. PATENT DOCUMENTS 3,370,624 A * 2/1968 Terrill ..... F17C 13/084 141/382
5,026,016 A * 6/1991 Lisowski ..... H04R 1/08 248/225.11

(Continued)

FOREIGN PATENT DOCUMENTS

| | | |
|---|---|---|
| EP | 0624752 | 11/1994 |
| EP | 0629812 | 12/1994 |
| EP | 2586481 | 5/2013 |

OTHER PUBLICATIONS

FR 1362596, French Search Report and Written Opinion, dated Jun. 30, 2014 (7 pages).

*Primary Examiner* — Jeffrey R Allen
(74) *Attorney, Agent, or Firm* — Allen E. White

(57) ABSTRACT

The invention relates to a container/container support assembly, notably for a medical gas cylinder, comprising a gas container (11) comprising a protective cap (3) comprising a peripheral wall (3), and a container support (20) able and designed to accept and bear said gas container (11). The protective cap (3) of the gas container (11) comprises a fixing element (10) projecting from the surface of the peripheral wall (3), and said container support (20) comprises an attachment system (24) for fixing said container support (20) to a bearing structure (30), and a housing (22) able and designed to accept said fixing element (10) borne by the protective cap (3) of the gas container (11) so as to secure said gas container (11) to said container support (20) when said fixing element (10) is positioned in said housing (22) of the container support (20).

12 Claims, 2 Drawing Sheets

(52) U.S. Cl.
CPC .. *F17C 2201/032* (2013.01); *F17C 2201/058* (2013.01); *F17C 2205/0188* (2013.01); *F17C 2205/0192* (2013.01); *F17C 2205/0308* (2013.01); *F17C 2205/0323* (2013.01); *F17C 2205/0329* (2013.01); *F17C 2205/0338* (2013.01); *F17C 2205/0394* (2013.01); *F17C 2209/2109* (2013.01); *F17C 2221/011* (2013.01); *F17C 2221/017* (2013.01); *F17C 2221/03* (2013.01); *F17C 2221/031* (2013.01); *F17C 2223/0123* (2013.01); *F17C 2223/035* (2013.01); *F17C 2250/043* (2013.01); *F17C 2250/0443* (2013.01); *F17C 2250/0491* (2013.01); *F17C 2260/015* (2013.01); *F17C 2270/02* (2013.01); *F17C 2270/05* (2013.01); *F17C 2270/0545* (2013.01)

(58) Field of Classification Search
CPC ..... F17C 2205/0192; F17C 2201/058; F17C 13/083; F17C 2205/0308
USPC ..... 248/478
See application file for complete search history.

(56) References Cited

U.S. PATENT DOCUMENTS

| | | | | |
|---|---|---|---|---|
| 5,249,702 | A | 10/1993 | Topp et al. | |
| 2008/0042028 | A1 | 2/2008 | Ross et al. | |
| 2009/0030384 | A1* | 1/2009 | Christen ..... | A61G 7/0503 604/319 |

* cited by examiner

ASSEMBLY OF A SUPPORT AND GAS CONTAINER SUCH AS A MEDICAL GAS CYLINDER

CROSS REFERENCE TO RELATED APPLICATIONS

This application claims the benefit of priority under 35 U.S.C. § 119 (a) and (b) to French Patent Application No. 1362596, filed Dec. 13, 2013, the entire contents of which are incorporated herein by reference.

BACKGROUND

The present invention relates to a container/container support assembly comprising a gas container, particularly a medical gas cylinder, comprising a protective cap, and a container support for accepting and bearing the gas container, said support comprising a fixing system to allow it to be fixed to a bearing structure, such as a partition, a wall, a hospital bed, a stretcher or a wheelchair, etc.

Containers, particularly medical gas cylinders, used notably in a hospital environment, in the home, by the emergency services or in emergency response vehicles, need to be able to be fixed to various supports, such as partitions, walls, hospital beds, stretchers, wheelchairs, etc.

They therefore need to be provided with their own attachment system borne by the container itself or, if appropriate, using an independent device that allows the container to be attached to a support.

Thus, document EP-A-629812 proposes the creation of a downwardly facing notch in the bottom part of the protective cap, also referred to as the "bonnet" with which a gas cylinder is equipped and which serves to protect the valve or the pressure regulator of the cylinder against knocks. This notch allows the cylinder to be hung from various supports, notably from the bars of beds.

Document EP-A-2586481 proposes equipping the protective cap of a gas cylinder with a pivoting attachment structure comprising two hooks so that the cylinder can be hung notably from the bars of hospital beds.

Moreover, wall-mounted systems intended to be fixed to a vertical support, for example to a wall or a partition, are also known, these taking the form of baskets or the like in which the bodies of the cylinders are inserted, the cylinders being held therein by straps or the like.

However, these systems are not entirely satisfactory and have disadvantages, namely notably:

- gas cylinders equipped with protective caps that have notches or hooks for securing purposes are not fixed stably because they are not fixed and may therefore fall, notably if somebody accidentally knocks the cylinder. This constitutes a risk to the user and to the equipment itself. In addition, it means that all cylinders need to be equipped with special-purpose protective caps, and this may represent a significant investment.
- Wall-mounted basket type systems are bulky and it is not always easy to manipulate the cylinders. Hence in general the gas cylinder needs to be lifted up so that it can be inserted into a housing of the basket, something which is not practical and may cause the user injury.

The problem to be addressed is therefore one of proposing an attachment system for a gas container, particularly for a gas cylinder, particularly for medical gas, that is improved, namely that does not have all or some of the aforementioned disadvantages, so as to minimize any situation of instability and limit the risks of the container, notably a gas cylinder, falling and of injuring the user.

SUMMARY

The solution of the invention is a container/container support assembly, comprising a gas container comprising a protective cap comprising a peripheral wall, and a container support able and designed to accept and bear said gas container, wherein:

the protective cap of the gas container comprises a fixing element projecting from the surface of the peripheral wall, and said container support comprising:

i) an attachment system for fixing said container support to a bearing structure, and ii) a housing able and designed to accept said fixing element borne by the protective cap of the gas container so as to secure said gas container to said container support when said fixing element is positioned in said housing of the container support.

Depending on the circumstance, the container/container support assembly of the invention may comprise one or more of the following technical features:

- The gas container is a gas cylinder equipped with a gas valve or gas pressure regulator around which the protective cap is arranged.
- The fixing element projects on the rear surface of the protective cap.
- The fixing element comprises a body secured to the wall of the protective cap comprising, at its free end, an enlarged head.
- The body of the fixing element is cylindrical and the enlarged head has the shape of a disk.
- The fixing element is formed as one piece with the protective cap, preferably by molding.
- The container support comprises a housing in the form of a notch.
- The container support comprises a housing in the form of a notch open at the top when the container support is fixed to a bearing structure.
- The notch-forming housing is formed in a U-shaped or V-shaped component.
- The container support comprises an attachment system allowing said container support to be fixed to a bearing structure selected from a rail, a bar or a wall.
- The housing of the container support comprises at least one retaining element arranged in such a way as to retain the fixing element in said housing of the container support, preferably two retaining elements.
- The housing of the container support comprises a back wall, said at least one retaining element being arranged spaced away from said back wall so as to sandwich the enlarged head of the fixing element between said at least one retaining element and said back wall when the fixing element is positioned in the housing of the container support.
- Said at least one retaining element comprises a leaf spring.
- The gas container is a gas cylinder, particularly a medical gas cylinder.
- The gas container is a cylinder of a medical gas selected from oxygen, air, oxygen-enriched air, a mixture of $N_2O$ and oxygen, of helium and oxygen, or some other mixture.

BRIEF DESCRIPTION OF THE DRAWINGS

The present invention will now be described in greater detail with reference to the attached Figures among which:

FIG. 1 depicts one embodiment of a support/container assembly, particularly for a medical gas cylinder, according to the invention.

DESCRIPTION OF PREFERRED EMBODIMENTS

Figure 1:
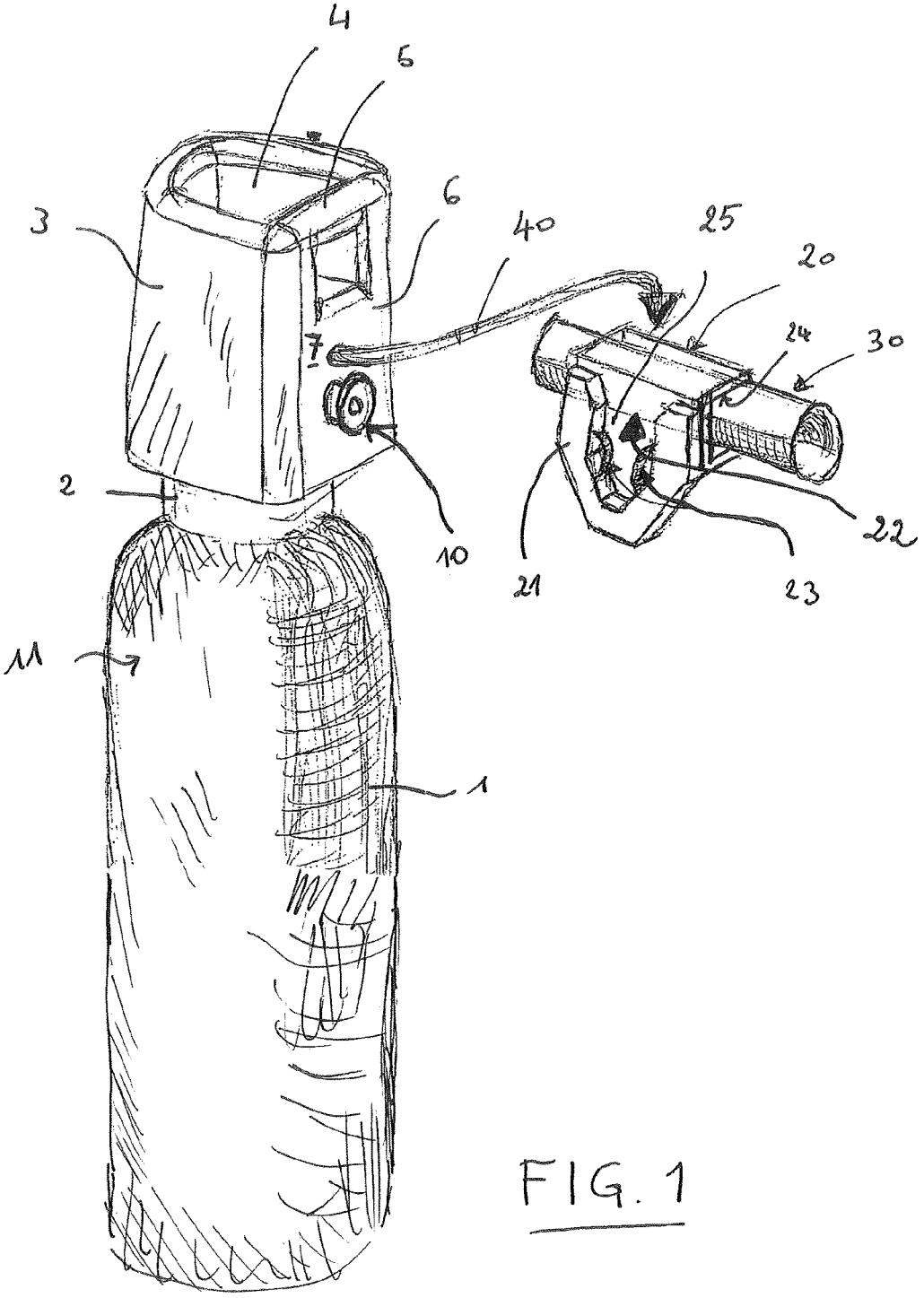
FIG. 1 depicts one embodiment of a support/container assembly according to the invention, FIG. 2 schematically depicts the fixing element of the support/container assembly of FIG. 1, and FIGS. 3 and 4 schematically illustrate the insertion of the fixing element of FIG. 2 into the housing of the container support of the support/container assembly of FIG. 1.

More specifically, the assembly formed of the gas container 11 and of its support 20 which is schematically illustrated in FIG. 1 comprises, on the one hand, a gas container 11, namely in this instance a medical gas cylinder, and, on the other hand, a container support 20 able and designed to accept said gas container 11 and support it.

The gas cylinder 11 is formed of a hollow body 1 of cylindrical shape inside which is stored a medical gas, in gaseous or liquefied form, for example oxygen, medical-grade air, a mixture of helium and oxygen, xenon, argon, CO, a mixture of NO and nitrogen, or any other gas.

The body 1 of the cylinder comprises, at its top end, a narrowing forming a neck 2 to which a valve or a valve with an in-built pressure regulator used for controlling the delivery of gas from the cylinder, particularly the flow rate and possibly pressure thereof is fixed, in the conventional way, for example by screwing in.

The valve or valve with in-built pressure regulator is equipped with one or more control members, such as a pivoting lever or a rotary knob and/or with one or more indicator members, such as a pressure gauge or a flow meter.

Moreover, the valve or valve with inbuilt pressure regulator is protected from knocks and dirt, notably from dust, by a protective cap 3, commonly referred to as a "bonnet", comprising a peripheral wall 3 forming a protective enclosure around said valve or pressure regulating valve. The protective cap 3 is generally fixed to the neck 2 of the body 1 of the cylinder 11. In the conventional way, a protective cap 3 is made of a metallic material or from a rigid plastic.

The cap 3 further comprises a top opening 4 giving access to the valve or the pressure regulating valve and other control members situated inside the enclosure of the cap 3. Part of the wall of the cap moreover forms a carry handle 5 to allow a user to carry and transport the cylinder 11.

Such a design of cylinder with a protective cap is notably described in document EP-A-629812 or EP-A-2586481.

According to the present invention, the protective cap 3 of the gas container 11 comprises a fixing element 10 projecting from the surface of the peripheral wall 3, namely the fixing element 10 protrudes outwards away from the external surface of the peripheral wall 6 of the cap 3, preferably the rear surface 7 of the cap 3.

Figure 2:
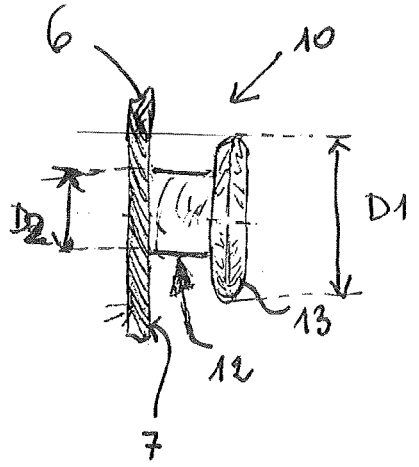

As illustrated in FIG. 2, the fixing element 10 here comprises a body 12 of elongate shape, secured to the wall 7 of the protective cap 3 and comprising, at its free end, an enlarged head 13.

In other words, the body 12 of the fixing element 10 connects to the wall 6 of the cap 3 via one of its ends and at its opposite end, i.e. at its free end, has the enlarged head 13 which has a first dimension, particularly a first diameter D1, that is greater than the second dimension, particularly a second diameter D2, of the body 12 (i.e. D1>D2).

In the embodiment of FIGS. 1 and 2, the body 12 of the fixing element 10 is of cylindrical shape of second diameter D2 and the enlarged head 12 has the shape of a disk of first diameter D1. For preference, the enlarged head 13 and the body 12 of the fixing element 10 are coaxial.

Advantageously, the fixing element 10 is formed as a single piece with the rear surface 7 of the wall 6 of the protective cap 3, preferably by molding or the like.

In particular, the fixing element 10 and the protective cap 3 are made of a plastics material such as PVC, PE, PET, PP, PMMA, PU, etc.

Figure 3:
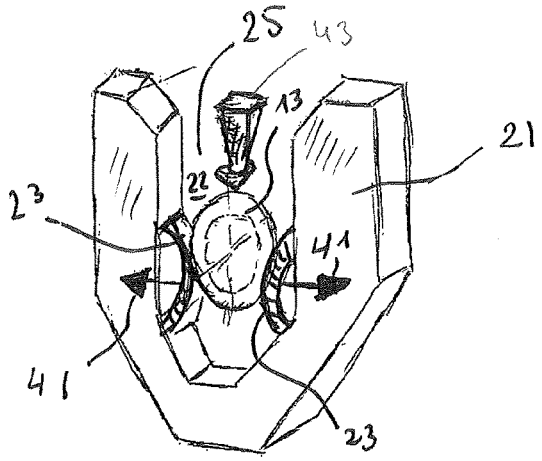
Figure 4:
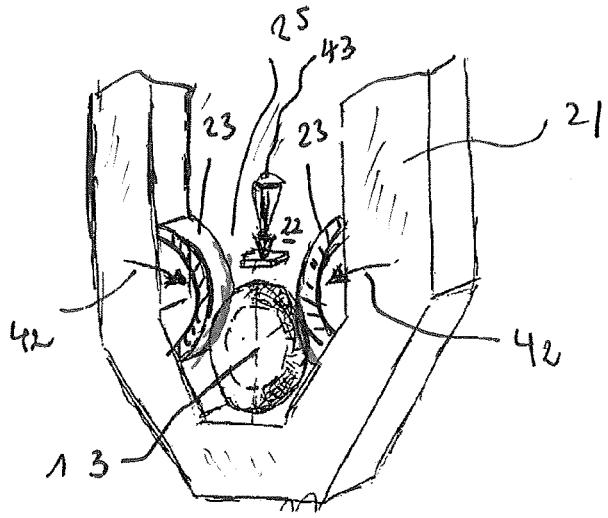

Moreover, the assembly according to the present invention also comprises a container support 20, illustrated in FIGS. 1, 3 and 4 and which comprises, on the one hand, an attachment system 24 allowing the container support 20 to be fixed to a bearing structure 30 such as a wall or a partition, or to a rail or a bar of a hospital bed, a stretcher, a wheelchair or the like and, on the other hand, a housing 22 intended to accept the fixing element 10 in such a way as to keep the cylinder 11 secured, i.e. attached, to said support 20.

In FIG. 1, the container support 20 is fixed to a bearing structure 30 of the bed bar type, i.e. of tubular shape with a diameter typically of the order of a few centimeters.

The attachment system 24 of the container support 20 is of any known type, for example a system using a screw, a clamp, etc.

Moreover, the container support 20 comprises a housing 22 able and designed to accept the fixing element 10 borne by the protective cap 3 of the gas container 11 so as to secure the container 11 to the container support 20 when the fixing element 10 is brought into position, i.e. inserted, by the user into the housing 22 of the container support 20. The positioning and the attachment of the gas cylinder 11 to the container support 20 is illustrated by the arrow 40 in FIG. 1.

For preference, the housing 22 is in the form of a U-shaped, V-shaped notch open at the top, as indicated schematically in FIGS. 1, 3 and 4. Specifically, such a shape makes it easier to secure the cylinder 11 to the support 20 and suspend it therefrom via a collaboration between the fixing element 10 and the housing 22, the fixing element 10 becoming lodged in the housing 22.

Moreover, the housing 22 of the container support 20 comprises one or more retaining elements 23, for example two retaining elements 23, arranged in such a way as to retain the fixing element 10 in said housing 22 of the container support 20, preferably two retaining elements 23 made of a resilient or flexible material. Thus, each retaining element 23 may be formed, in full or in part, of a flexible metal leaf, for example made of steel, able to deform slightly as the fixing element 10 is inserted into the housing 22, as indicated in FIGS. 3 and 4, i.e. in the direction of the arrow 43.

More specifically, when the fixing element 10 enters the housing 22 (FIG. 3) it pushes back the flexible leaves 20 in the direction of the arrows 41 so as to move them apart and, at the same time, allow the cylindrical body 12 of the fixing element 10 to pass between said leaves 23.

The fixing element 10 can therefore be lodged in the bottom of the V-shaped or U-shaped housing, and the leaves then return toward one another on account of their resilience, in the direction of the arrows 42 of FIG. 4.

The fixing element 10 is disengaged and extracted from the housing 22 by a movement in the opposite direction.

In fact, the housing 22 of the container support 20 comprises a back wall 25, preferably a flat wall, and the retaining elements 23 are arranged externally with respect to this back wall 25 and such that they are spaced away from said back wall 25 so as to "sandwich" the enlarged head 13 of the fixing element 10 between the retaining elements 23 and said back wall 25 when the fixing element 10 is inserted (arrow 43) into the housing 22 of the container support 20, as visible in FIG. 4.

Whatever the embodiment considered, the container/container support assembly of the invention allows medical gas cylinders of different diameters to be fixed easily, stably and safely so as to minimize the falls of cylinders and therefore limit the risk of injury to the user and damage to the equipment.

In any event, the present invention is not restricted to the medical field and can be used in other fields where gases stored in gas containers, such as cylinders, are used, notably in the food, electronics, welding/cutting, etc. fields.

What is claimed is:

1. A container/container support assembly, comprising:

a gas container (11) comprising a protective cap (3) comprising a peripheral wall (3), and a container support (20) able and designed to accept and bear said gas container (11), wherein:

the protective cap (3) of the gas container (11) comprises a fixing element (10) projecting from the surface of the peripheral wall (3), and said container support (20) comprises:

i) an attachment system (24) for fixing said container support (20) to a load bearing structure (30), and ii) a housing (22) able and designed to accept said fixing element (10) borne by the protective cap (3) of the gas container (11) so as to secure said gas container (11) to said container support (20) when said fixing element (10) is connected with said housing (22) of the container support (20), wherein the housing (22) in the form of a notch is open at the top when the container support (20) is fixed to the load bearing structure (30).

2. The assembly of claim 1, wherein the gas container (11) is a gas cylinder equipped with a gas valve or gas pressure regulator around which the protective cap (3) is arranged.

3. The assembly of claim 1, wherein the fixing element (10) projects on a rear surface wall (7) of the protective cap (3).

4. The assembly of claim 1, wherein the fixing element (10) comprises a body (12) secured to a wall (7) of the protective cap (3) comprising, at its free end, an enlarged head (13).

5. The assembly of claim 4, wherein the body (12) of the fixing element (10) is cylindrical and the enlarged head (13) has the shape of a disk.

6. The assembly of claim 1, wherein the fixing element (10) is formed as one piece with the protective cap (3).

7. The assembly of claim 1, wherein the housing (22) is in the form of a notch.

8. The assembly of claim 1, wherein the notch-forming housing (22) is formed in a U-shaped or V-shaped component (21).

9. The assembly of claim 1, wherein the attachment system (24) is able and designed to allow said container support (20) to be fixed to the load bearing structure (30) which is selected from a rail, a bar or a wall.

10. The assembly of claim 1, wherein the housing (22) of the container support (20) comprises at least one retaining element (23) arranged in such a way as to retain the fixing element (10) in said housing (22) of the container support (20).

11. The assembly of claim 10, wherein the housing (22) of the container support (20) comprises a back wall (25), said at least one retaining element (23) being arranged spaced away from said back wall (25) so as to sandwich an enlarged head (13) of the fixing element (10) between said at least one retaining element (23) and said back wall (25) when the fixing element (10) is positioned in the housing (22) of the container support (20).

12. The assembly claim 10, wherein said at least one retaining element (23) comprises a leaf spring.

* * * * *